US010138915B2

(12) United States Patent
Bhaskar et al.

(10) Patent No.: US 10,138,915 B2
(45) Date of Patent: Nov. 27, 2018

(54) METHOD OF CONTROLLING VELOCITY OF A HYDRAULIC ACTUATOR IN OVER-CENTER LINKAGE SYSTEMS

(71) Applicant: Parker-Hannifin Corporation, Cleveland, OH (US)

(72) Inventors: Vivek Bhaskar, Charlotte, NC (US); Bjoern Eriksson, Johanneshov (SE); Ralf Gomm, Foster City, CA (US)

(73) Assignee: Parker-Hannifin Corporation, Cleveland, OH (US)

( * ) Notice: Subject to any disclaimer, the term of this patent is extended or adjusted under 35 U.S.C. 154(b) by 169 days.

(21) Appl. No.: 15/312,959

(22) PCT Filed: May 15, 2015

(86) PCT No.: PCT/US2015/031024
§ 371 (c)(1),
(2) Date: Nov. 21, 2016

(87) PCT Pub. No.: WO2015/195246
PCT Pub. Date: Dec. 23, 2015

(65) Prior Publication Data

US 2017/0184139 A1 Jun. 29, 2017

Related U.S. Application Data

(60) Provisional application No. 62/014,765, filed on Jun. 20, 2014.

(51) Int. Cl.
*F15B 21/08* (2006.01)
*E02F 9/22* (2006.01)
(Continued)

(52) U.S. Cl.
CPC ..... *F15B 21/087* (2013.01); *E02F 9/2095* (2013.01); *E02F 9/2203* (2013.01);
(Continued)

(58) Field of Classification Search
CPC .. F15B 21/087; F15B 2211/45; F15B 11/024; E02F 9/22; E02F 9/2203
(Continued)

(56) References Cited

U.S. PATENT DOCUMENTS

2014/0123639 A1 5/2014 Akiyama et al.

FOREIGN PATENT DOCUMENTS

WO 2010/030830 3/2010

OTHER PUBLICATIONS

International Search Report and Written Opinion for corresponding International Patent Application No. PCT/US2015/031024 dated Sep. 9, 2015.

(Continued)

*Primary Examiner* — Thomas E Lazo
*Assistant Examiner* — Daniel Collins
(74) *Attorney, Agent, or Firm* — Renner Otto Boisselle and Sklar

(57) ABSTRACT

An electro-hydraulic actuation system includes a regeneration valve in fluid communication with a first fluid chamber and a second fluid chamber of a hydraulic actuator, and a dump valve is in fluid communication with the second fluid chamber and a fluid reservoir. A pump provides a flow of fluid to the first and second fluid chambers, a displacement of the pump controlling a velocity of the actuator during motion in the retraction and extension directions. An electric motor drives the pump, and a controller controls a state of the regeneration valve and the dump valve. At least one feedback device senses a system condition and provides a respective feedback signal indicative of the sensed system condition to the controller, the controller responsive to the feedback signal to determine an occurrence of an over-center load condition and control a state of the regeneration
(Continued)

valve and the dump valve in response to the occurrence to maintain the velocity of the actuator.

20 Claims, 12 Drawing Sheets

(51) Int. Cl.

| | |
|---|---|
| ***F15B 7/00*** | (2006.01) |
| ***F15B 11/024*** | (2006.01) |
| ***E02F 9/20*** | (2006.01) |
| ***F15B 11/08*** | (2006.01) |
| ***F15B 13/02*** | (2006.01) |
| ***F15B 13/04*** | (2006.01) |
| ***F15B 19/00*** | (2006.01) |
| *E02F 3/32* | (2006.01) |

(52) U.S. Cl.
CPC ..... *E02F 9/2217* (2013.01); *E02F 9/2228* (2013.01); *E02F 9/2271* (2013.01); *E02F 9/2289* (2013.01); *F15B 7/006* (2013.01); *F15B 11/024* (2013.01); *F15B 11/08* (2013.01); *F15B 13/028* (2013.01); *F15B 13/0401* (2013.01); *F15B 19/005* (2013.01); *E02F 3/32* (2013.01); *F15B 2211/20515* (2013.01); *F15B 2211/20538* (2013.01); *F15B 2211/20561* (2013.01); *F15B 2211/27* (2013.01); *F15B 2211/3052* (2013.01); *F15B 2211/3058* (2013.01); *F15B 2211/30515* (2013.01); *F15B 2211/41581* (2013.01); *F15B 2211/613* (2013.01); *F15B 2211/63* (2013.01); *F15B 2211/634* (2013.01); *F15B 2211/6336* (2013.01); *F15B 2211/6346* (2013.01); *F15B 2211/7051* (2013.01); *F15B 2211/7053* (2013.01); *F15B 2211/761* (2013.01)

(58) Field of Classification Search
USPC ..... 60/468, 431, 494
See application file for complete search history.

(56) References Cited

OTHER PUBLICATIONS

International Preliminary Report on Patentability for corresponding International Patent Application No. PCT/US2015/031024 dated Jun. 10, 2016.

ARM POSITION: NEUTRAL

ARM POSITION: OUT

ARM POSITION: IN

METHOD OF CONTROLLING VELOCITY OF A HYDRAULIC ACTUATOR IN OVER-CENTER LINKAGE SYSTEMS

This application is a national phase of International Application No. PCT/US2015/031024 filed May 15, 2015 and published in the English language.

FIELD OF INVENTION

The present disclosure relates generally to a hydraulic actuation system for extending and retracting at least one unbalanced hydraulic actuator. More particularly, the present disclosure relates to velocity control of an unbalanced hydraulic actuator that is subjected to over-center load conditions.

BACKGROUND INFORMATION

Hydraulic actuators in many machines are subjected to varying loads, including overrunning loads and resistive loads. An overrunning load (also referred to as an aiding load) is a load that acts in the same direction as the motion of the actuator. Examples of overrunning loads include lowering a wheel loader boom or lowering an excavator boom, each with gravity assistance. A resistive load is a load that acts in the opposite direction as the motion of the actuator. Examples of resistive loads include raising a wheel loader boom or raising an excavator boom, each against the force of gravity.

In certain applications, hydraulic actuators can be subjected to both an overrunning load and a resistive load in the same extend or retract stroke. For example, and with reference to FIG. 1, an exemplary excavator linkage is shown whereby the arm function is positioned in three different positions:

a.) Arm in "neutral" position, cylinder roughly at half displacement;

b.) Arm in "out" position, cylinder retracted; and c.) Arm in "in" position, cylinder extended.

When an excavator arm actuator that is fully retracted (arm linkage "out") is given an extension command (arm linkage curling "in"), the motion starts with an overrunning load and then switches to resistive load due to the linkage configuration. The arm actuator in this case is said to have gone "over-center". The same holds true when the actuator is retracted and goes from an overrunning load to a resistive load as the arm linkage moves outward. The transition between the resistive load and the overrunning load without a change in the direction of motion is referred to herein as an "over-center load condition." An over-center load condition may occur during a transition from a resistive load to an overrunning load and during a transition from an overrunning load to a resistive load.

In existing hydraulic control systems using spool valves, pressurized hydraulic fluid is supplied from a pump to the cylinder (actuator) and hydraulic fluid flows out of the actuator to a tank. The flow of hydraulic fluid to the actuator and out of the actuator is controlled by a spool, the flow direction being dictated by a position of the spool. The design of a four way spool valve is such that a given position of the spool determines the "flow in" and the "flow out" restriction sizes. Thus, metering in and metering-out are coupled, where a certain restriction size on the inlet corresponds to a certain restriction size on the outlet. Therefore, it is a one degree of freedom system and, as a result, only one of the speed or the hydraulic force can be independently controlled. Such limitation can make it challenging to properly control the desired actuator behavior when transitioning between a resistive load and an overrunning load (i.e., an over-center load condition).

For example, it is desirable that an over-center load condition not affect the velocity of retraction or extension of the actuator. Such velocity control is particularly difficult when the hydraulic actuator is an unbalanced actuator of an electro-hydraulic actuation (EHA) system. An EHA system is a system in which a reversible, variable speed electric motor is connected to a hydraulic pump, generally fixed displacement, for providing fluid to an actuator for controlling motion of the actuator. An unbalanced actuator has unequal cross-sectional areas on opposite sides of the piston, generally as a result of a rod being attached to only one side of the piston. Due to the unbalanced nature of the actuator, as the system transitions into an over-center condition, a speed change occurs in the actuator motion due to the unequal cross-sectional area between the head-side and rod-side of the actuator. Such change in speed is undesirable, as it is difficult for a user to predict when the change will occur and thus can make it difficult to precisely position the working machine during the over-center event.

Further, spools are typically designed such that the outlet is restricted to limit fluid flow and prevent a load from falling at uncontrollable speeds in the event of an overrunning load. However, in other operating conditions, such as lifting the load, such restriction is not needed yet it is inherent in the design of the spool valve. This causes undesired energy loss.

SUMMARY OF INVENTION

The present disclosure provides an apparatus and method that enable the velocity of hydraulic actuators to be controlled during an over-center load and cylinder mode switch in an energy-efficient manner without causing discontinuities in cylinder velocity. More particularly, the apparatus and method in accordance with the present disclosure control hydraulic orifices or valves in conjunction with pump speed modifications to maintain a desired cylinder piston velocity throughout an over-center event. The apparatus and method in accordance with the present disclosure can be applied to various hydraulic systems, and in particular to closed circuit electro-hydrostatic actuation systems with fixed displacement two-port pumps, such as disclosed in U.S. Patent Publication No. US 2011/0030364, which is incorporated by reference in its entirety.

The apparatus and method in accordance with the present disclosure maintains the pump or actuator in a desired quadrant of operation to account for discrete changes in actuator net flow (due to over-center events) by the use of valve throttling and creating alternative flow paths. The choice of which valves to open, timing and amount of throttling depend on the direction of motion of the linkage, commanded linkage speed and detection of pump operating quadrant. As a result of using valve throttling, the change in the speed command of the pump can be minimized, thereby reducing the effect of introducing unstable or possibly chaotic behavior.

According to one aspect of the invention, an electro-hydraulic actuation system includes: an unbalanced hydraulic actuator capable of motion in retraction and extension directions during movement of a load, the actuator including a first fluid chamber having a first cross-sectional area and a second fluid chamber having a second cross-sectional area, the second cross-sectional area being greater than the first cross-sectional area, the actuator operable in at least one of an actuator second quadrant or an actuator third quadrant; a regeneration valve in fluid communication with the first fluid chamber and the second fluid chamber, the regeneration valve operable to selectively couple the first fluid chamber to the second fluid chamber; a dump valve in fluid communication with the second fluid chamber and a fluid reservoir, the dump valve operable to selectively couple the second fluid chamber to the reservoir; a pump for providing a flow of fluid to the first and second fluid chambers, a displacement of the pump controlling a velocity of the actuator during motion in the retraction and extension directions; an electric motor for driving the pump, the motor operable in at least one of a first quadrant or a fourth quadrant of operation; a controller for controlling a state of the regeneration valve and the dump valve; and at least one feedback device for sensing a system condition and for providing a respective feedback signal indicative of the sensed system condition to the controller, the controller being responsive to the respective feedback signal for determining an occurrence of an over-center load condition and for controlling a state of the regeneration valve and the dump valve in response to the occurrence in an attempt to maintain the velocity of the actuator.

According to one aspect of the invention, the controller is configured to determine the occurrence of the over-center load condition based on at least one of a quadrant of operation of the motor or a quadrant of operation of the actuator.

According to one aspect of the invention, the controller is configured to command the dump valve to a full open position when the actuator is operating in the third quadrant.

According to one aspect of the invention, the system includes a user input device (42) for generating a command corresponding to motion of the actuator.

According to one aspect of the invention, the controller is configured to operate the dump valve as a function of the command when the actuator is operating in the second quadrant.

According to one aspect of the invention, the function is a linear function.

According to one aspect of the invention, the function is a non-linear function.

According to one aspect of the invention, the system includes: a first load holding valve in fluid communication with the first fluid chamber and the pump, the first load holding valve operable to enable or inhibit fluid flow between the pump and the first fluid chamber; and a second load holding valve in fluid communication with the second fluid chamber and the pump, the second load holding valve operable to enable or inhibit fluid flow between the pump and the second fluid chamber, wherein when the actuator is operating in the third quadrant the controller is configured to operate the regeneration valve as a function of the command, and close the first and second load holding valves.

According to one aspect of the invention, the controller is further configured to calculate a new pump speed.

According to one aspect of the invention, the controller is configured to calculate the pump speed using the equation $Q_{pump\ new}=(Q_{head\ required}/AR)*(AR-1)$, where $Q_{pump\ new}$ is the calculated pump speed, $Q_{head\ required}$ is the calculated flow into the head side of the actuator that results in the required actuator velocity command, and AR is the ratio between the cross sectional area of the second chamber relative to the cross sectional area of the first chamber.

According to one aspect of the invention, the system includes: a first load holding valve in fluid communication with the first chamber and the pump, the first load holding valve operable to enable or inhibit fluid flow between the pump and the first chamber; and a second load holding valve in fluid communication with the second chamber and the pump, the second load holding valve operable to enable or inhibit fluid flow between the pump and the second, wherein when the motor is operating in the fourth quadrant the controller is configured to command the regeneration valve to close and the first and second load holding valves to open.

According to one aspect of the invention, when the motor is operating in the fourth quadrant the controller is configured to calculate the pump speed using the equation $Q_{pump\ new}=Q_{head\ required}/AR$, where $Q_{pump\ new}$ is the calculated pump speed, $Q_{head\ required}$ is the calculated flow into the head side of the actuator that results in the required actuator velocity command, and AR is the ratio between the cross sectional area of the second chamber relative to the cross sectional area of the first chamber.

According to one aspect of the invention, the feedback device is adapted to sense at least one of a position of a piston of the actuator relative to a housing of the actuator, a velocity of the piston of the actuator relative to the housing of the actuator, or a direction of rotation and current of the motor.

According to one aspect of the invention, the feedback device is located in one of the electric motor or a power electronic controller associated with the electric motor.

According to one aspect of the invention, the controller determines the occurrence of an over-center load condition when a sign of the current changes while a direction of rotation of the electric motor remains unchanged.

According to one aspect of the invention, the feedback device is an actuator position sensing device that is adapted to sense a position of the piston relative to the housing and to provide feedback signals to the system controller at regular intervals, the system controller determining the velocity of the actuator from the feedback signals.

According to one aspect of the invention, the system controller also receives input signals indicative of a desired actuator velocity from an operator input device, the system controller being responsive to a difference between the desired actuator velocity and the determined actuator velocity for modifying the speed of the electric motor.

According to one aspect of the invention, the actuator includes a piston/rod assembly that divides the actuator into the first fluid chamber and the second fluid chamber and moves relative to a housing of the actuator during motion in the retraction and extension directions, one of the first and second fluid chambers being a high pressure chamber during movement of the piston/rod assembly relative to the housing, upon the occurrence of an over-center load condition the high pressure chamber switching to the other of the first and second fluid chambers, the feedback device being responsive to the switching of the high pressure chamber for providing the feedback signal to the controller.

According to one aspect of the invention, the system further includes a charge pump system and a shuttle valve that is responsive to a pressure differential between first and second conduits for connecting the charge pump system in fluid communication with one of the first and second chambers, upon the occurrence of an over-center load condition the shuttle valve switching positions to connect the charge pump system in fluid communication with the other of the first and second fluid chambers, the feedback device (82) being adapted to sense a position of the shuttle valve.

According to one aspect of the invention, the controller determines the occurrence of an over-center load condition when a direction of movement of the piston/rod assembly relative to the housing remains unchanged when the shuttle valve shifts positions.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF INVENTION

Figure 2:
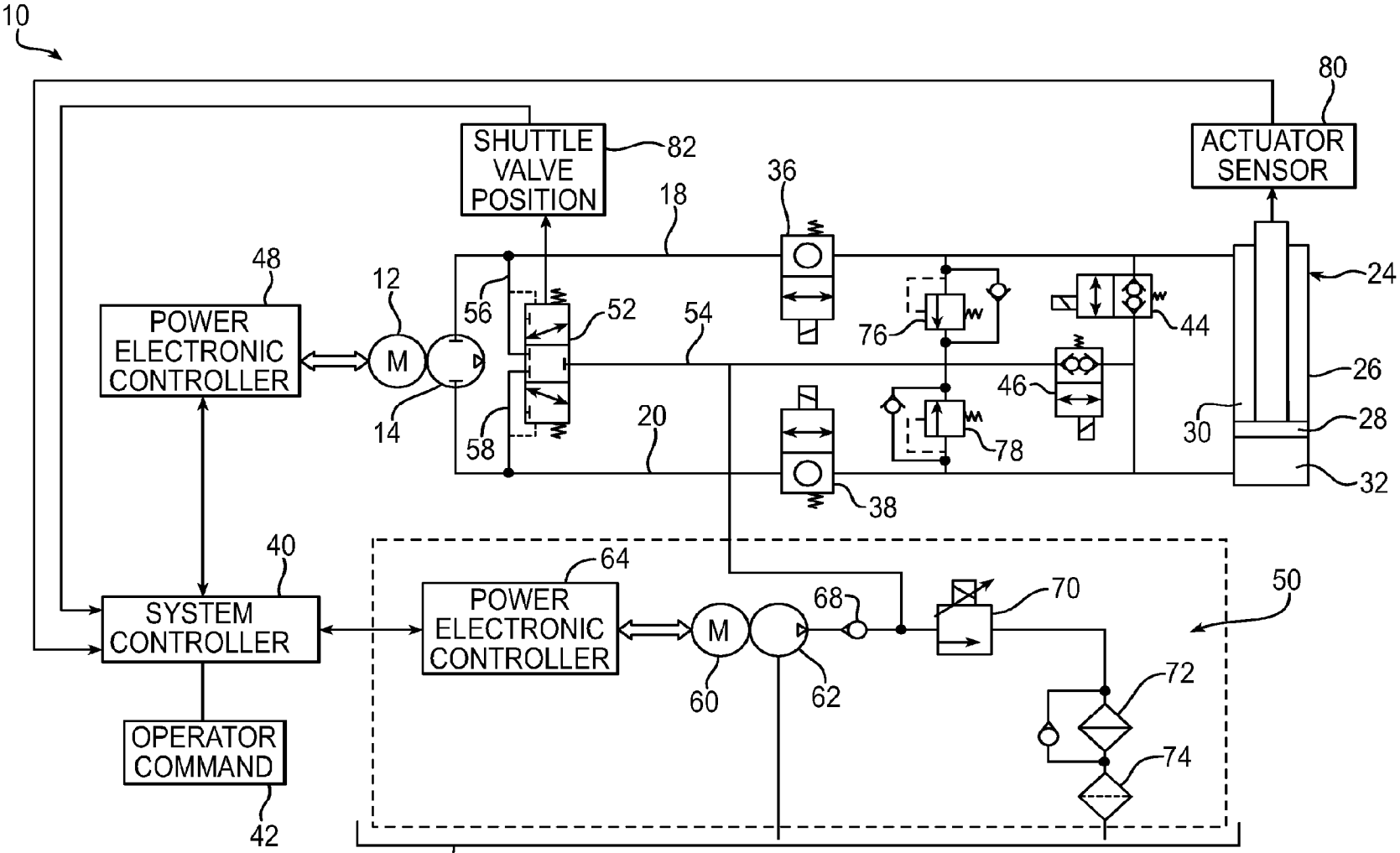
FIG. 2 illustrates an exemplary embodiment of a system constructed in accordance with the present disclosure and incorporating multiple feedback devices.

FIG. 2 illustrates an exemplary embodiment of a system 10 constructed in accordance with the present disclosure. The system 10 includes an electric motor 12 that is operatively coupled to and drives a hydraulic pump 14. The electric motor 12 may be a reversible, variable speed electric motor. In the embodiment of FIG. 2, the hydraulic pump 14 is a fixed displacement two port pump. Alternatively, other types of pumps, such as a variable displacement pump or a three port fixed displacement pump, may be used. When driven in a first direction by the electric motor 12, the hydraulic pump 14 provides fluid into conduit 18. When driven in a second direction opposite the first direction, the hydraulic pump 14 provides fluid into conduit 20.

The system 10 also includes a hydraulic actuator 24. The actuator 24 of FIG. 2 is an unbalanced hydraulic actuator having a housing 26, a piston/rod assembly 28, a rod-side chamber 30 (also referred to as a first chamber), and a head-side chamber 32 (also referred to as a second chamber). The hydraulic actuator 24 is unbalanced due to the cross-sectional area of the head-side chamber 32 being greater than the cross-sectional area of the rod-side chamber 30. As a result, when the actuator 24 is extended more fluid is needed to fill the head-side chamber 32 of the actuator 24 than is being discharged from the rod-side chamber 30. Conversely, when the actuator 24 is retracted, less fluid is needed to fill the rod-side chamber 30 than is being discharged from the head-side chamber 32.

Conduit 18 extends between the pump 14 and the rod-side chamber 30 and, conduit 20 extends between the pump 14 and the head-side chamber 32. Each conduit 18 and 20 has an associated load holding valve 36 and 38, respectively. The load holding valves 36 and 38 may be two position, solenoid operated valves controlled by a system controller 40, which may include a processor and memory for executing logical instructions (e.g., software stored in memory and executable by the processor). In one embodiment, the load holding valves 36 and 38 are proportionally controllable orifice valves for flow control valves. The load holding valves 36 and 38 are used to prevent fluid flow out of the rod-side chamber 30 and out of the head-side chamber 32, respectively, when no motion of the actuator 24 is desired. This allows the electric motor 12 to remain in a low energy state while the holding valves 36 and 38 maintain pressure in the actuator 24.

Also included in the system 10 are a hydraulic regenerative valve 44 and a dump valve 46. The regenerative valve 44 connects the head-side chamber 32 of the hydraulic actuator 24 directly to the rod-side chamber 30. This enables flow to be directly exchanged from one side to the other without going through the pump 14. The dump valve 46 provides a connection from the head-side chamber 32 of the actuator 24 to a reservoir 66, thereby allowing for an alternate but not mutually exclusive path for flow out of the head-side chamber 32. The regeneration and dump valves 44 and 46, for example, may be proportionally controllable orifice valves or flow control valves.

A first pressure relive valve 76 connects the rod-side chamber 32 to conduit 54, and second pressure relief valve 78 connects the head-side chamber 32 to conduit 54. The relief valves 76 and 78 function to limit the pressure at the respective chambers 30 and 32. For example, if the machine is inadvertently driven into an object, the pressure in the chamber can easily exceed the maximum rated pressure of the actuator 24. The pressure relief valves 76 and 78 can prevent such excessive pressure from developing in the system. The relief valves 76 and 78 also provide an anti-cavitation function, as they allow flow from the charge pump system (described below) to the actuator 24, for example, when the actuator is moved only by external forces as described above. Such operation can minimize accumulation of air in the actuator 24.

The system controller 40 receives input (or command) signals from an operator input device 42, such as joysticks or similar devices. The system controller 40 converts the input signals into desired velocity command signals that are sent to a power electronic controller 48. The power electric controller 48 may be a separate device from the system controller 40 or may form a portion of the system controller. The power electric controller 48 is responsive to the desired velocity command signals for the powering the electric motor 12.

The system 10 of FIG. 2 also includes a charge pump system 50. The charge pump system 50 is in communication with conduits 18 and 20 via an associated shuttle valve 52 and associated conduits 54, 56 and 58. The shuttle valve 52 automatically changes position in response to the pressure differential between the conduits 18 and 20 to connect the low pressure conduit to the charge pump system 50. The charge pump system 50 includes an electric motor 60 that is operatively coupled to a fixed displacement hydraulic charge pump 62. The electric motor 60 receives power from an associated power electronic controller 64, which may be a separate device from controllers 40 and 48 or may be a common device as one or both of the controllers. Upon receiving electric power, the electric motor 60 drives the pump 62 to draw fluid from a reservoir 66 (e.g., a storage tank) and to provide the fluid through a check valve 68 and into conduit 54 that is connected to the shuttle valve 52. A flow control valve 70, which is controlled by the system controller 40, controls the flow of fluid through the conduit 54. When the flow control valve 70 is closed, as illustrated in FIG. 2, the flow of fluid from the charge pump 62 is directed into the conduit 54 and toward the shuttle valve 52. When the flow control valve 70 is open, the flow of fluid from the charge pump 62, when operating, and the flow of fluid through the conduit 54 from the shuttle valve 52 are directed to the reservoir 66 via an oil cooler 72 and filter 74. The charge pump system 50 functions to provide fluid to the inlet side of the pump 14 to prevent cavitation and to make up for any differential in fluid resulting from the actuator 24 being unbalanced.

FIG. 2 also illustrates an optional actuator position sensing device 80 and an optional shuttle valve position sensing device 82, each of which can sense a system condition indicative of the occurrence of an over-center load condition. The actuator position sensing device 80 is adapted to sense a position of the piston of the piston/rod assembly 28 relative to the housing 26 of the actuator 24 and to provide feedback signals indicative of the sensed actuator position to the system controller 40. In an alternate embodiment, a device adapted to sense a velocity of the piston relative to the housing 26 of the actuator 24 and to provide feedback signals indicative of the sensed actuator velocity to the system controller 40 may be used in place of the actuator position sensing device 80. The shuttle valve position sensing device 82 is adapted to sense a position of the shuttle valve 52 and to provide feedback signals indicative of the sensed shuttle valve position to the system controller 40.

With continued reference to the actuator of FIG. 2, a velocity of the actuator 24 (i.e., the velocity at which the piston moves relative to the housing 26) is a function of the rate of change in volume of the chamber 30 or 32 having the highest pressure. The rate of change in volume is a function of the displacement of the pump 14 and the cross-sectional area of the respective chamber 30 or 32. When an actuator 24 is unbalanced, the cross-sectional area of the rod-side chamber 30 differs from the cross-sectional area of the head-side chamber 32. Thus, for the same displacement of the pump 14, the rate of change in volume of the head-side chamber 32, which has the larger cross-sectional area, is less than the rate of change in volume of the rod-side chamber 30. As a result, for the same displacement, the velocity of the actuator 24 is lower when the head-side chamber 32 is the high pressure chamber than when the rod-side chamber 30 is the high pressure chamber.

For example, when the cross-sectional area of the head-side chamber 32 is twice that of the rod-side chamber 30, for the same displacement of the pump 14, the velocity of the actuator 24 when the head-side chamber 32 is the high pressure chamber is one-half the velocity of the actuator 24 when the rod-side chamber 30 is the high pressure chamber. Switch of the high pressure chamber from the rod-side chamber 30 to the head-side chamber 32 or alternatively, from the head-side chamber 32 to the rod-side chamber 30, as a result of an over-center load condition results in a change in velocity that is a function of the ratio of the cross-sectional areas of the chambers 30 and 32.

Figure 3A:
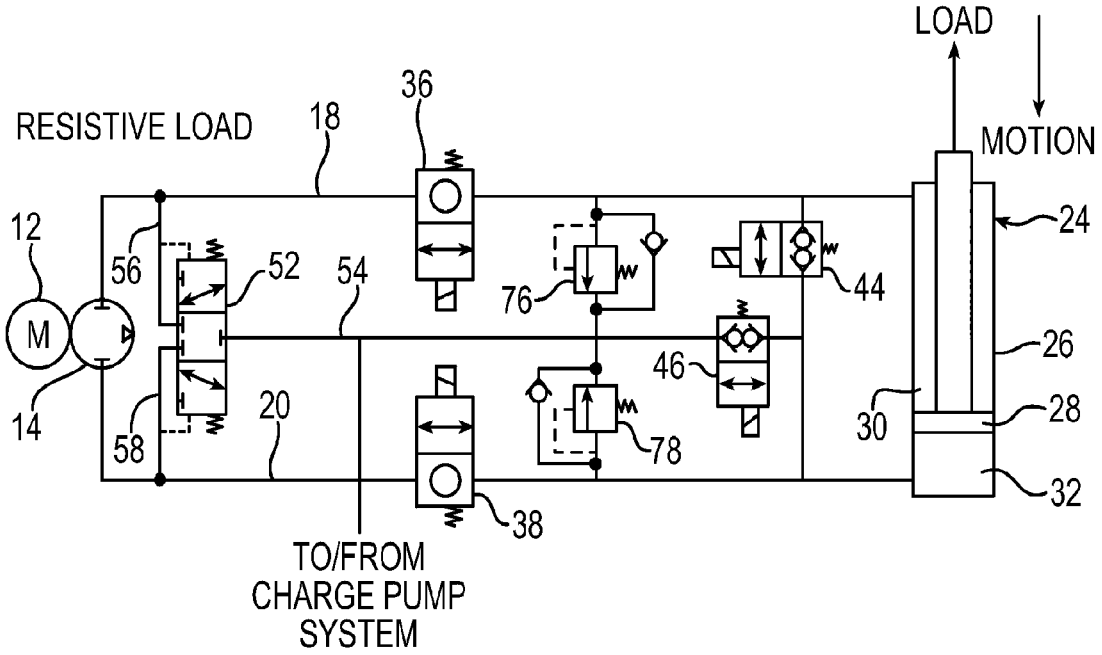
FIG. 3A illustrates a portion of the system of FIG. 2 with a shuttle valve in a first position.

FIG. 3A illustrates a portion of the system 10 of FIG. 2 with the actuator 24 experiencing a resistive load and with a motion of the actuator 24 in a retraction direction. Thus, the load is directed opposite the direction of motion. In this particular example, the rod-side chamber 30 and associated conduit 18 is at a pressure that is higher than the pressure of the head-side chamber 32 and associated conduit 20 (the rod-side chamber 30 is the high pressure chamber), which forces the shuttle valve 52 to connect the charge pump system 50 to the low-pressure head-side chamber 32. To continue motion of the actuator 24 in the retraction direction, fluid is provided from the pump 14 via conduit 18 to the rod-side chamber 30 to increase the volume of the rod-side chamber. The displacement of the pump 14 controls the velocity of the actuator 24.

Figure 3B:
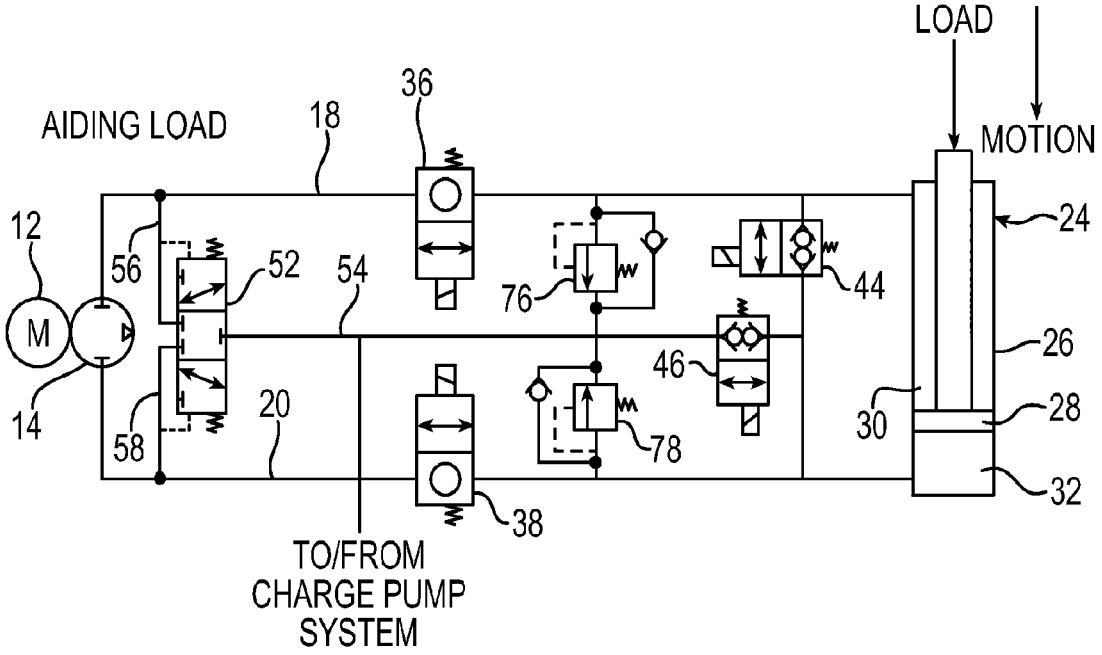
FIG. 3B illustrates the portion of the system of FIG. 2 with the shuttle valve in a second position.

When an over-center load condition occurs, the direction of motion remains the same (e.g., in the retraction direction) but the direction of the load changes. FIG. 3B illustrates the portion of the system 10 of FIG. 3A after the occurrence of an over-center load condition. As shown in FIG. 3B, the motion of the actuator 24 remains in the retraction direction while the load is now directed in the same direction as the motion and opposite the direction illustrated in FIG. 3A. When the load shifts direction at the occurrence of the over-center load condition, the head-side chamber 32 and associated conduit 20 suddenly have a pressure that is higher than the pressure of the rod-side chamber 30 and associated conduit 18 (the head-side chamber is now the high pressure chamber), forcing shuttle valve 52 to connect the charge pump system 50 to the rod-side chamber 32. As a result, the pump 14 acts as a hydraulic motor and, the displacement of the pump 14 controls the rate of flow out the head-side chamber 32. As the head-side chamber 32 has a larger cross-sectional area than the rod-side chamber 30, the displacement of the pump 14 must be increased to maintain the velocity of the actuator 24 consistent with that experienced prior to the over-center load condition.

Consider, for example, the situation in which the head-side chamber 32 has a cross-sectional area that is two times the cross-sectional area of the rod-side chamber 30. In the scenario illustrated in FIG. 3A, the displacement of the pump 14 is being provided to the rod-side chamber 30 (the high pressure chamber) to force the piston/rod assembly 28 in the retraction direction. When the over-center load condition occurs, the head-side chamber 32 becomes the high pressure chamber and the hydraulic pump 14, acting as a hydraulic motor, acts to resist (or retard) the flow of fluid out of the head-side chamber 32. If the displacement of the hydraulic pump 14 remains constant after the occurrence of the over-center load condition, the flow of fluid out of the head-side chamber 32 at the same quantity as was flowing into the rod-side chamber 30 prior to the over-center load condition results in an actuator velocity of one-half of the actuator velocity experienced prior to the over-center load condition. Such change in velocity is due to the change in cross-sectional area between the head-side chamber 32 and the rod-side chamber 30. In this scenario, for the same pump displacement, the rate of change in volume of the head-side chamber 32 is one-half the rate of change in volume of the rod-side chamber 30. The velocity change at the actuator 24 is directly related to the ratio of the cross-sectional areas of the head-side chamber 32 and the rod-side chamber 30.

Figure 4:
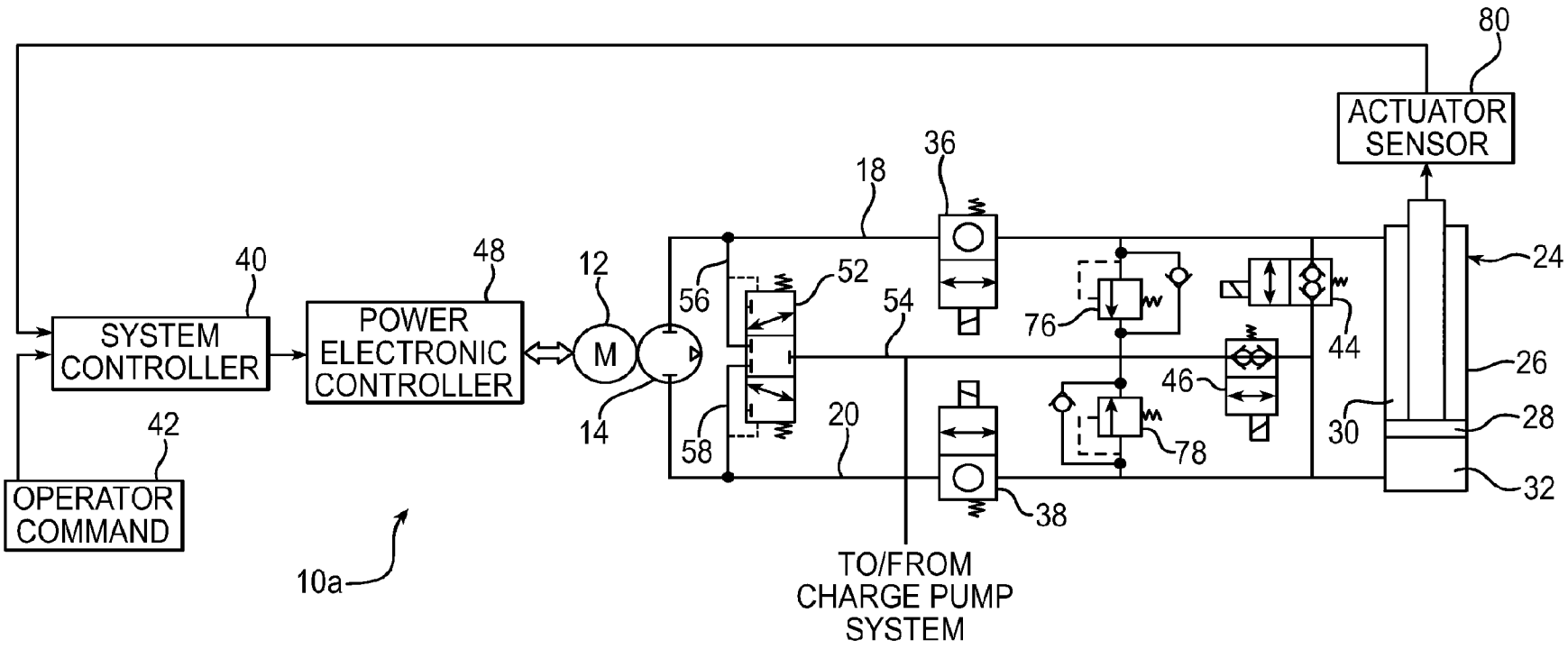
FIG. 4 illustrates a partial view of another exemplary embodiment of a system constructed in accordance with the present disclosure.

FIG. 4 illustrates a partial view of another exemplary embodiment of a system 10*a* constructed in accordance with the present disclosure. In FIG. 4, the structures that are the same as those described with reference to FIG. 2 are labeled with the same reference numbers and, if described previously, the description of those structures will be omitted. The system 10*a* of FIG. 4 acts to maintain a desired actuator velocity after the occurrence of an over-center load condition. The actuator position sensing device 80 senses the position of the piston relative to the housing 26 of the actuator 24 and provides feedback signals indicative of the sensed position to the system controller 40. The system controller 40 is responsive to the feedback signals for determining an actual velocity of the piston relative to the housing 26. The system controller 40 is responsive to the actual velocity for adjusting the desired velocity command signals provided to the power electronics controller 48 to maintain the velocity of the actuator 24 after the occurrence of the over-center load condition.

In an exemplary control scheme for the system 10*a* of FIG. 4, the actuator position sensing device 80 senses the position of the piston relative to the housing 26 at periodic intervals, such as once every 5 milliseconds, and provides a piston position feedback signal to the system controller 40 after each interval. The piston position feedback signal is conditioned as necessary and is used to determine a velocity of the piston relative to the housing 26, such as by the differential of the position over time. An error signal is determined by finding the difference between the actual velocity and the desired velocity and, the error signal is used to adjust the desired velocity command signals.

For additional control, one may further use a PID (Proportional Integral Derivative) control scheme after adjusting the desired velocity command signal with the error signal. Upon the occurrence of an over-center load condition, a sudden change in the actuator velocity due to switching of the high pressure chamber results in a change in the determined actual velocity and thus, a change in the error signal. The error signal is used to adjust the desired velocity command signals to modify the speed of the electric motor 12 in an attempt to maintain the velocity of the actuator consistent with the velocity experienced immediately prior to the occurrence of the over-center load condition.

Figure 5:
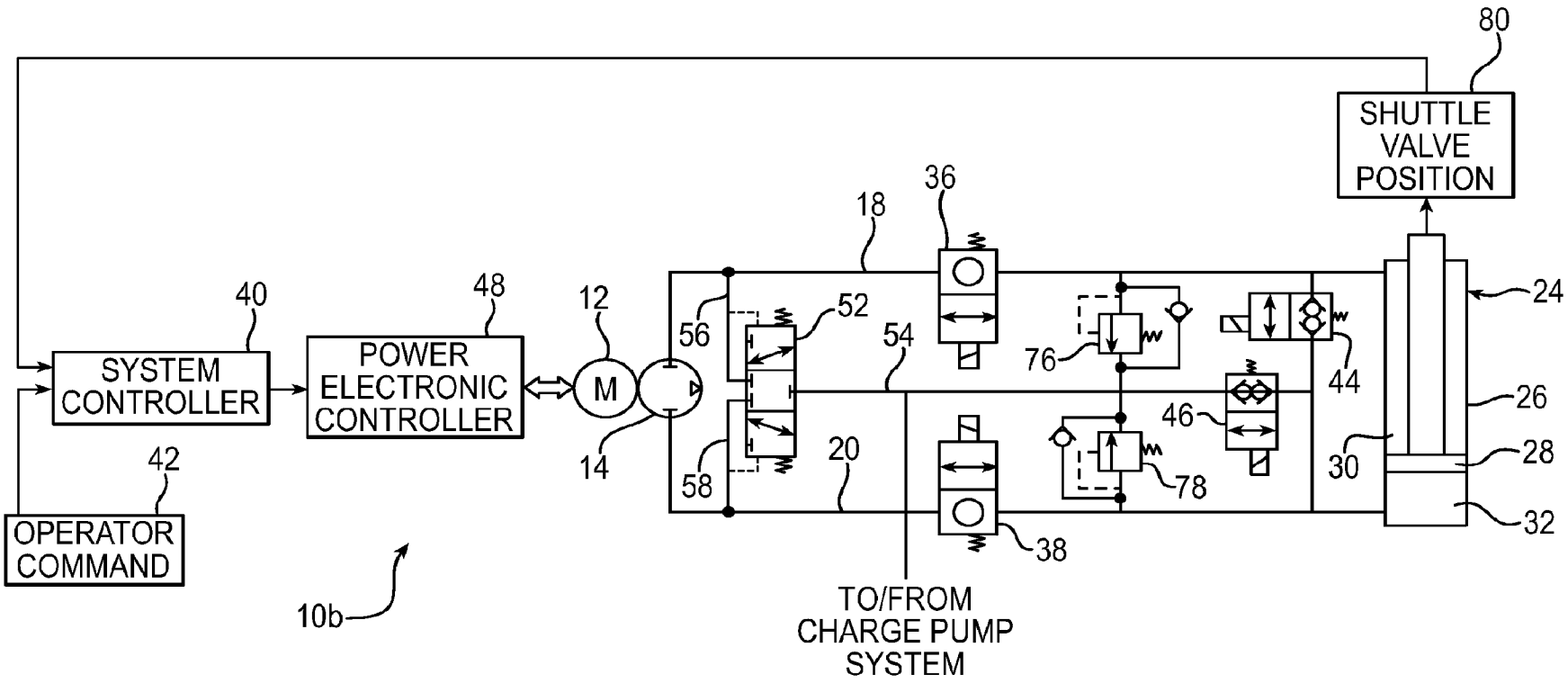
FIG. 5 illustrates a partial view of yet another exemplary embodiment of the present disclosure.

FIG. 5 illustrates a system 10*b* constructed in accordance with another embodiment of the present disclosure. In FIG. 5, the structures that are the same as those described with reference to FIG. 2 are labeled with the same reference numbers and, if described previously, the description of those structures will be omitted. In the system 10*b* of FIG. 5, the shuttle valve position sensing device 82 provides a feedback signal for helping the system controller 40 to maintain the velocity of the actuator in response to the occurrence of an over-center load condition.

As stated previously, the shuttle valve 52 automatically changes position in response to a pressure differential between the conduits 18 and 20 to connect the low pressure conduit to the charge pump system 50. With reference to FIG. 3A, high pressure in conduit 18 forces the shuttle valve 52 downward, as viewed in FIG. 3A, to the illustrated position. When the shuttle valve 52 is in the position illustrated in FIG. 3A, fluid exiting the head-side chamber 32 that is in excess of the fluid provided to the rod-side chamber 30 is directed through the shuttle valve 52 and to the charge pump system 50 for return to the reservoir 66. FIG. 3B illustrates the system of FIG. 3A after the occurrence of an over-center load condition. When the load shifts direction at the occurrence of the over-center load condition, the high pressure chamber shifts to the head-side chamber 32. As a result, the shuttle valve shifts 52 from the position illustrated in FIG. 3A to the position illustrated in FIG. 3B.

After the occurrence of an over-center load condition, if the electric motor 12 speed is kept constant (i.e., pump displacement also remains constant), there will be an undesired change in velocity, as described above. Upon the occurrence of the over-center load condition, however, the shuttle valve 52 shifts position to connect the charge pump system 50 to the low pressure conduit. The system 10*b* of FIG. 5 senses the shifting of the position of the shuttle valve 52 and is responsive to the sensed shift for adjusting the speed of the electric motor 12 and thus, the pump 14 displacement, for attempting to maintain the velocity of the actuator 24. The shuttle valve position sensing device 82 is adapted to sense the position of the shuttle valve 52 at regular intervals and to provide feedback signals indicative of the sensed shuttle valve 52 position to the system controller 40. The system controller 40 is responsive to receiving the feedback signal from the shuttle valve position sensing device 82 for modifying the speed of the electric motor 12.

Figure 6:
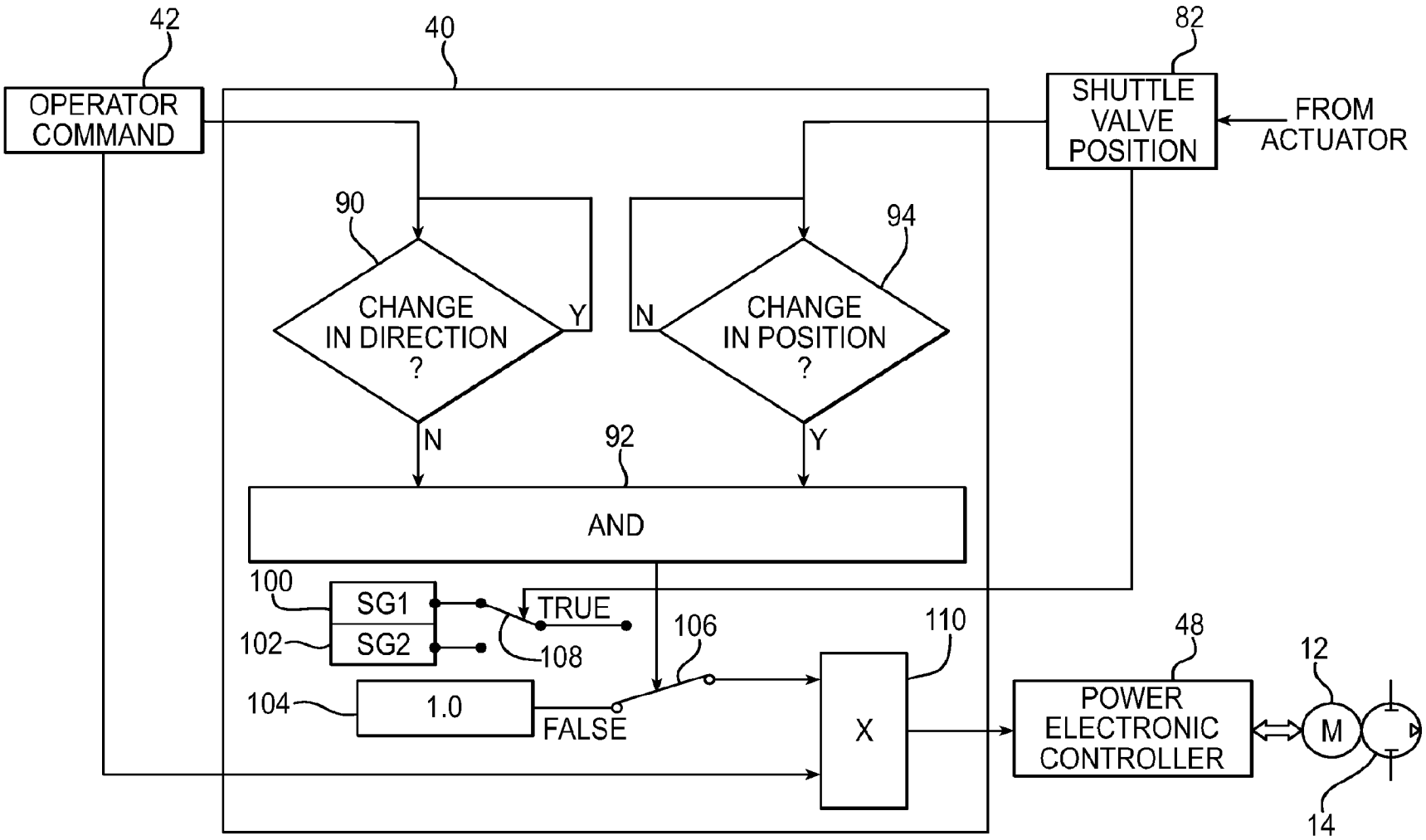
FIG. 6 is an exemplary control schematic for the system of FIG. 5.

FIG. 6 is an exemplary control schematic for the system of FIG. 5. In FIG. 6, an input signal output by the operator input device 42 is provided to the system controller 40. The input signal indicates a desired velocity of the actuator 24 and thus, includes a speed component and a direction component. The system controller 40 conditions the input signal as necessary and provides the direction component of the input signal to a desired direction determination function, illustrated schematically at 90 in FIG. 6. The desired direction determination function 90 receives the direction component of the input signal at regular intervals. The desired direction determination function 90 compares each received direction component with the preceding received direction component to determine whether the input signal has requested a change in direction. When no change in direction is determined, the desired direction determination function 90 outputs a TRUE signal to a logical conjunction (AND) function, illustrated schematically at 92 in FIG. 6. When a change in direction is determined, the desired direction determination function 90 outputs a FALSE signal to a logical conjunction function 92 of the system controller 40.

The system controller 40 also includes a shuttle valve position determination function, illustrated schematically at 94 in FIG. 6. The shuttle valve position determination function 94 receives the shuttle valve position feedback signal at regular intervals from the shuttle valve position sensing device 82. The shuttle valve position determination function 94 compares each received shuttle valve position feedback signal with the preceding received shuttle valve position feedback signal to determine whether the shuttle valve 52 has shifted position. When a shift in position is determined, the shuttle valve position determination function 94 outputs a TRUE signal to the logical conjunction function 92. When no shift in position is determined, the shuttle valve position determination function 94 outputs a FALSE signal to a logical conjunction function 92.

The logical conjunction function 92 evaluates the signals received from the desired direction determination function 90 and the shuttle valve position determination function 92. When an over-center load condition occurs, the signals from both the desired direction determination function 90 and the shuttle valve position determination function 92 are TRUE.

If one of the signals from the desired direction determination function 90 and the shuttle valve position determination function 92 is FALSE, an event other than an over-center load condition has occurred, such as, e.g., a requested change of direction by the operator.

The logical conjunction function 92 outputs a gain signal for controlling a gain function of the system controller 40 in response to determining whether an over-center load condition has occurred. In FIG. 6, the gain function is illustrated by a first, second and third gain values 100, 102, and 104, respectively, and two switches 106 and 108 that are controllable for outputting one of the first, second and third gain values. Switch 106 is controlled by the gain signal output from the logical conjunction function 92. When the logical conjunction function 92 determines that an over-center load condition has occurred (i.e., a TRUE determination), switch 106 is positioned to be connected with one of the first and second gain values 100 and 102. When the logical conjunction function 92 determines that no over-center load condition has occurred (i.e., a FALSE determination), switch 106 is positioned to connect with the third gain value, as is shown in FIG. 6. The third gain value 104 is equal to one. Switch 108 is controlled by the shuttle valve position sensing device 82. When the shuttle valve position sensing device 82 determines that the shuttle valve 52 is in a first position, such as the position illustrated in FIG. 3A, switch 108 is positioned to connect with the first gain value 100. When the shuttle valve position sensing device 82 determines that the shuttle valve 52 is in a second position, such as the position illustrated in FIG. 3B, switch 108 is positioned to connect with the second gain value 102. The first and second gain values 100 and 102 may be calculated and are a function of the cross-sectional areas of the rod-side chamber 30 and head-side chamber 32 of the actuator 24.

Depending upon the position of the switches 106 and 108, one of the first, second and third gain values 100, 102, or 104 is provided to a multiplication function 110 of the system controller 40. The input signal from the operator input device 42 also is provided to the multiplication function 110. The multiplication function 110 operates to multiply the speed component of the input signal by the received gain value 100, 102, or 104 and to output the desired velocity command signals to the power electronics controller 48 for controlling the speed and direction of the electric motor 12 and thus, the pump 14 displacement. When an over-center load condition is determined by the logical conjunction function 92, the system controller 40 modifies the desired velocity command signals based upon the selected first or second gain value 100 or 102 to modify the electric motor 12 speed. If, for example, the shuttle valve 52 shifts from the position illustrated in FIG. 3A to the position illustrated in FIG. 3B, the system controller 40 modifies the desired velocity command signal to increase the speed of the electric motor 12 to increase the displacement of the pump 14. If, on the other hand, the shuttle valve 52 shifts from the position illustrated in FIG. 3B to the position illustrated in FIG. 3A, the system controller 40 modifies the desired velocity command signal to decrease the speed of the electric motor 12 to decrease the displacement of the pump 14. When no over-center load condition is determined, the system controller 40 does not modify the desired velocity command signals (i.e., the third gain value 104 equals one).

Figure 7:
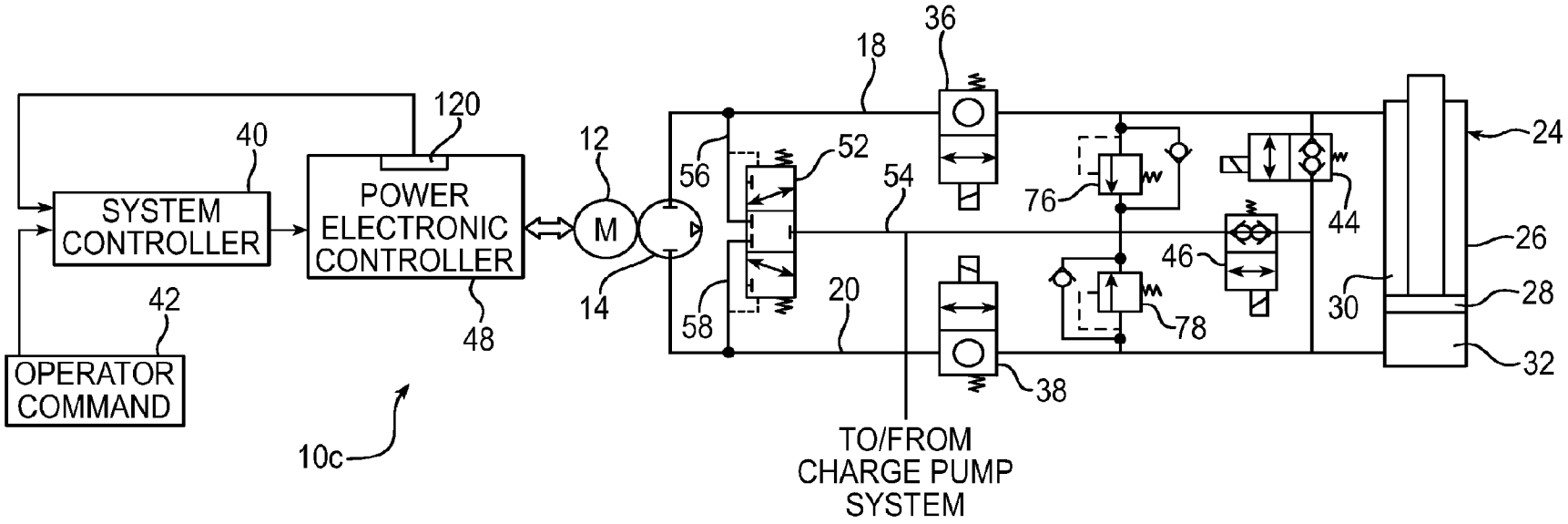
FIG. 7 illustrates a partial view of still another exemplary embodiment of a system constructed in accordance with the present disclosure.

FIG. 7 illustrates a system 10*c* constructed in accordance with yet another embodiment of the present invention. In FIG. 7, the structures that are the same as those described with reference to FIG. 2 are labeled with the same reference numbers and, if described previously, the description of those structures will be omitted. The system 10*c* of FIG. 7 also attempts to maintain a velocity of the actuator in response to the occurrence of an over-center load condition.

In the system 10*c* of FIG. 7, the power electronics controller 48, or alternatively the electric motor 12, or both, has a feedback device 120 for outputting a feedback signal indicative of the electric current and the speed of the electric motor 12. FIG. 7 illustrates the power electronics controller 48 having the current and speed feedback device 120. The speed of the electric motor 12 can, for example, be obtained through resolvers, encoders or software calculations if a sensor-less electric motor is employed. Electric current typically is available within the power electronics controller 48 through output current measurements probes. The speed and current feedback signal is provided to the system controller 40, which utilizes the feedback signal to attempt to maintain a velocity of the actuator in response to the occurrence of an over-center load condition.

Figure 8A:
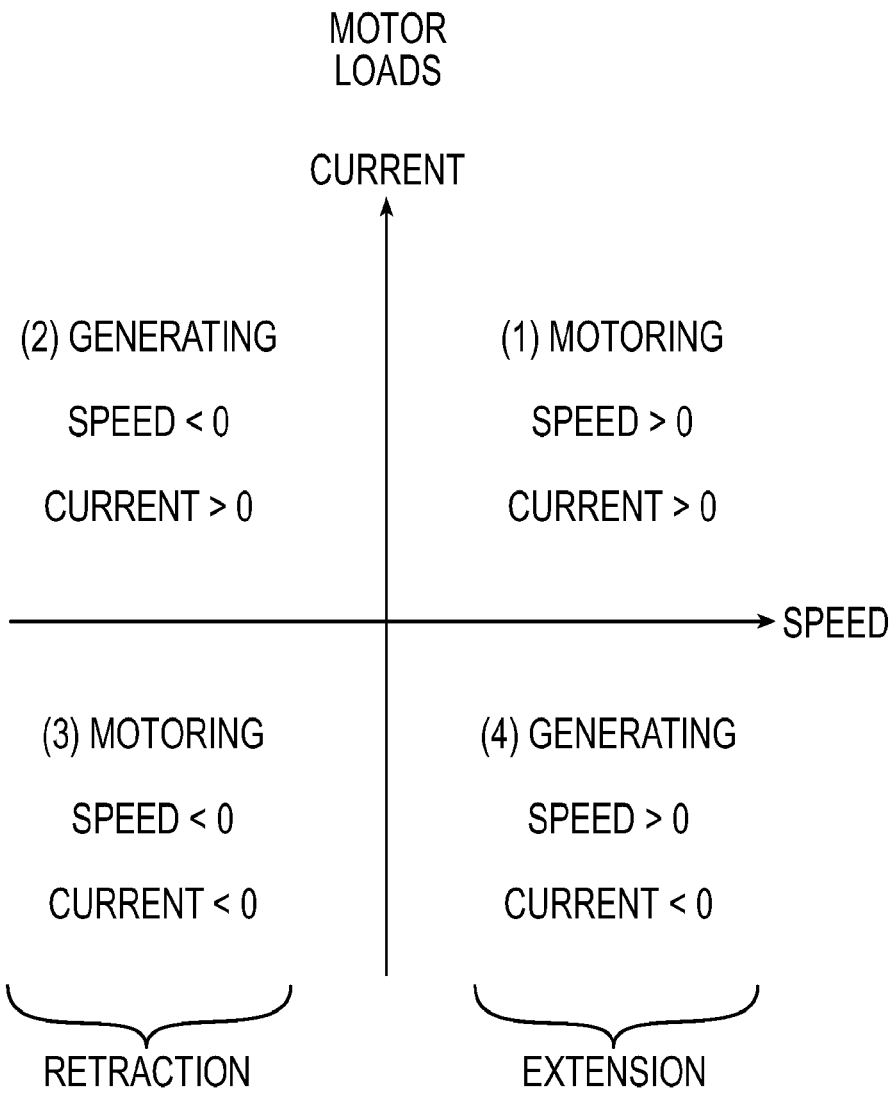
FIG. 8A illustrates four-quadrant operation of an electric motor during motion of an actuator of an EHA system.

FIG. 8A illustrates four-quadrant operation of an electric motor 12 during movement of an actuator 24 with the speed of the electric motor 12 on an X-axis and the electric current draw of the electric motor 12 on the Y-axis. In FIG. 8A, a positive speed of the electric motor 12 results in motion of the actuator 24 in the extension direction and a negative speed results in motion of the actuator 24 in the retraction direction. During motion in the extension direction, a positive speed and a positive current draw (quadrant (1)) is indicative of a motoring mode of the electric motor 12 (i.e., the electric motor consumes energy), while during motion in the retraction direction, a negative speed and a negative current draw (quadrant (3)) is indicative of a motoring mode of the electric motor 12. The electric motor 12 is in the motoring mode when the high pressure chamber of the actuator 24 is expanding in volume, for example, the rod-side chamber 30 of FIG. 3A. The electric motor 12 also has a generating mode in which the electric motor produces energy. The generating mode occurs when the high pressure chamber of the actuator 24 is decreasing in volume, for example, the head-side chamber 32 of FIG. 3B, and the hydraulic pump 14 acts to as a motor to control the flow of fluid out of the high pressure chamber. When the hydraulic pump 14 acts as a motor, the electric motor 12 is rotated by the pump and electric energy is produced. During motion in the extension direction, a positive speed and a negative current draw (quadrant (4)) is indicative of a generating mode, while during motion in the retraction direction, a negative speed and a positive current draw (quadrant (2)) is indicative of a generating mode.

Figure 8B:
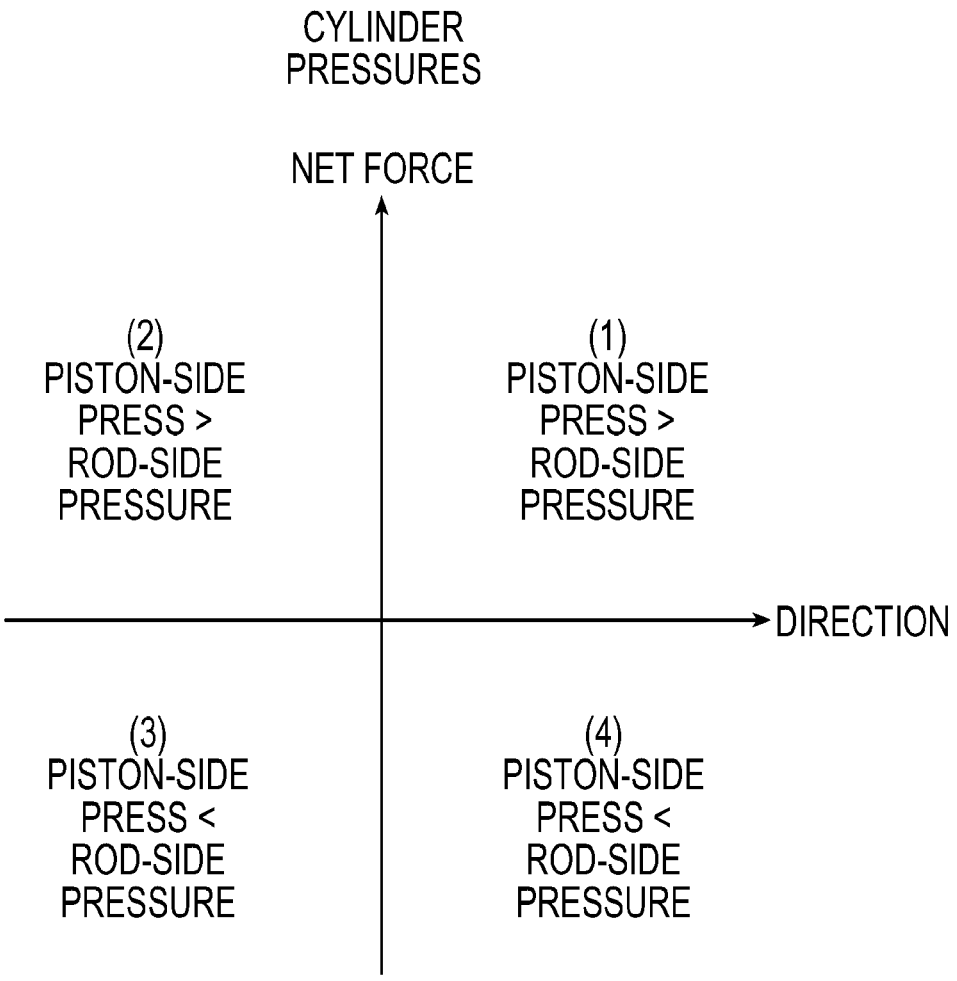
FIG. 8B illustrates four-quadrant operation of a hydraulic cylinder during motion of an actuator of an EHA system.

FIG. 8B illustrates four-quadrant operation of the hydraulic actuator 24 with direction of movement of the actuator 24 on the X-axis and the net force on the actuator 24 on the Y-axis. In FIG. 8B, a positive direction of the actuator 24 results in motion in the extension direction and a negative direction results in motion in the retraction direction. Quadrant (1) is defined by motion of the actuator 24 in the extension direction with a positive pressure differential between the head-side pressure and the rod-side pressure ($P_{head\text{-}side}>P_{rod\text{-}side}$), while Quadrant (2) is defined by motion of the actuator 24 in the retraction direction with a positive pressure differential between the head-side pressure and the rod-side pressure. Quadrant (3) is defined by motion of the actuator 24 in the retraction direction with a negative pressure differential between the head-side pressure and the rod-side pressure ($P_{head\text{-}side}<P_{rod\text{-}side}$), while Quadrant (4) is defined by motion of the actuator 24 in the extension direction with a negative pressure differential between the head-side pressure and the rod-side pressure.

Assuming an ideal (i.e., lossless) system, both the actuator 24 and the motor would be in the same quadrants. However, due to losses, the actuator and motor may switch quadrants at different times.

The system 10*c* of FIG. 7 uses the speed and current information provided in the speed and current feedback signal to detect the occurrence of an over-center load condition. As discussed previously with reference to FIGS. 3(*a*) and 3(*b*), the high pressure chamber of the actuator 24 changes from (i) the rod-side chamber 30 to the head-side chamber 32, or (ii) from the head-side chamber 32 to the rod-side chamber 30 during motion in the same direction upon the occurrence of an over-center load condition. This change results in the electric motor 12 switching from (i) a motoring mode to a generating mode, or (ii) from a generating mode to a motoring mode. Thus, a change in the sign of the current from (i) positive to negative, or (ii) negative to positive without a change in the direction of the speed is indicative of the occurrence of an over-center load condition. The system controller 40 is responsive to the speed and current feedback signal indicating the occurrence of an over-center load condition for modifying the speed of the electric motor 12 to attempt to maintain a velocity of the actuator in response to the occurrence of an over-center load condition.

Figure 9:
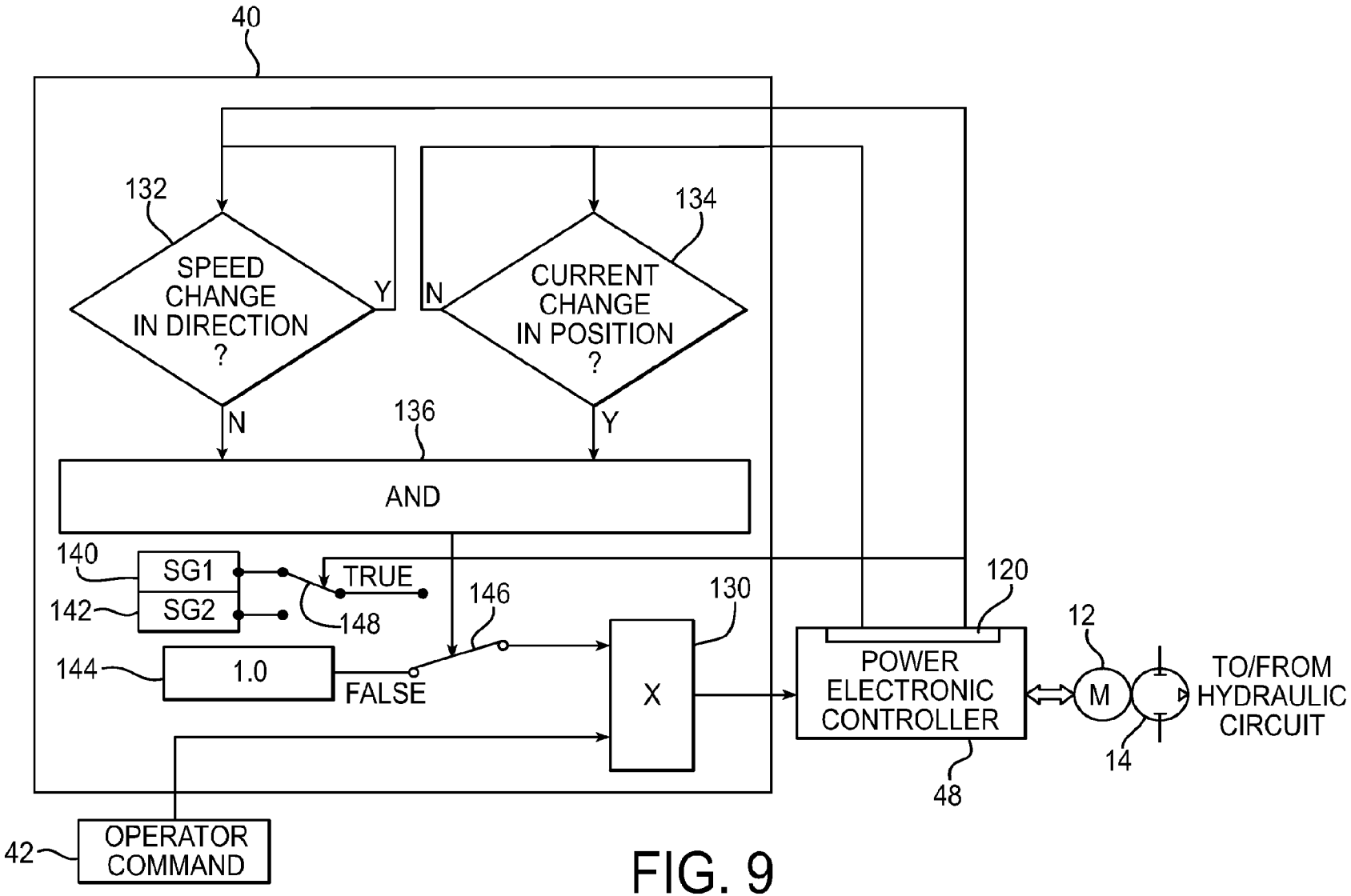
FIG. 9 is an exemplary control schematic for the system of FIG. 7.

FIG. 9 is an exemplary control schematic for the system 10*c* of FIG. 7. In FIG. 9, an input signal output by the operator input device 42 is provided to the system controller 40. The input signal indicates a desired velocity of the actuator 24 and thus, includes a speed component and a direction component. The system controller 40 conditions the input signal as necessary and provides the input signal a multiplication function 130. The system controller 40 also receives the feedback signal from the current and speed feedback device, conditions the feedback signal as necessary, and provides the speed component to a direction determination function, illustrated schematically at 132 in FIG. 9, and provides the current component to a current sign determination function, illustrated schematically at 134 in FIG. 9.

The direction determination function 132 receives the speed component at regular intervals. The direction determination function 132 compares the sign of each received speed component with the sign of the preceding received speed component to determine whether the motor has changed direction, i.e., determine whether there was a change of the sign of the speed component from positive to negative or from negative to positive. When no change in direction is determined, the direction determination function 132 outputs a TRUE signal to a logical conjunction (AND) function, illustrated schematically at 136 in FIG. 9. When a change in direction is determined, the direction determination function 132 outputs a FALSE signal to a logical conjunction function 136.

The current sign determination function 134 receives the current component of the feedback signal at regular intervals. The current sign determination function 134 compares the sign of each received current component with the sign of the preceding received current component to determine whether the electric motor 12 has shifted between motoring and generating modes. When a shift in modes is determined, the current sign determination function 134 outputs a TRUE signal to the logical conjunction function 136. When no shift in modes is determined, the current sign determination function 134 outputs a FALSE signal to the logical conjunction function 136.

The logical conjunction function 136 evaluates the signals received from the direction determination function 132 and the current sign determination function 134. When an over-center load condition occurs, the signals from both the direction determination function 132 and the current sign determination function 134 are TRUE. If one of the signals from the direction determination function 132 and the current sign determination function 134 is FALSE, an event other than an over-center load condition occurred, such as, e.g., a requested change of direction by the operator. The logical conjunction function 136 outputs a gain signal for controlling a gain function of the system controller 40 in response to determining whether an over-center load condition has occurred.

In FIG. 9, the gain function is illustrated by a first, second and third gain values 140, 142, and 144 and two switches 146 and 148 that are controllable for outputting one of the first, second and third gain values. Switch 146 is controlled by the gain signal output from the logical conjunction function 136. When the logical conjunction function 136 determines that an over-center load condition has occurred (i.e., a TRUE determination), switch 146 is positioned to be connected with one of the first and second gain values 140 and 142. When the logical conjunction function 136 determines that no over-center load condition has occurred (i.e., a FALSE determination), switch 146 is positioned to connect with the third gain value 144, as is shown in FIG. 9. The third gain value 144 is equal to one. Switch 148 is controlled by the speed component of the feedback device 120. When the feedback device 120 determines that the sign of the speed is positive (motion in the extension direction per FIG. 8A), switch 148 is positioned to connect with the first gain value 140. When the feedback device 120 determines that the sign of the speed is negative (motion in the retraction direction per FIG. 8A), switch 148 is positioned to connect with the second gain value 142. The first and second gain values 140 and 142 may be calculated and are a function of the cross-sectional areas of the rod-side chamber 30 and head-side chamber 32 of the actuator 24.

Depending upon the position of the switches 146 and 148, one of the first, second, and third gain values 140, 142, and 144 is provided to the multiplication function 130 of the system controller 40. The input signal also is provided to the multiplication function 130 of the system controller 40. The multiplication function 130 operates to multiply the speed component of the input signal by the gain signal and to output a desired velocity command signal to the power electronics controller 48 for controlling the electric motor 12 and thus, the pump 14 displacement. When an over-center load condition is determined to have occurred by the logical conjunction function 136, the system controller 40 modifies the desired velocity command signal to the power electronics controller 48 to modify the speed of the electric motor 12 in an attempt to maintain the velocity of the actuator 24. When a determination is made that no over-center load condition has occurred, the system controller 40 does not modify the desired velocity command signals (i.e., the third gain value 144 equals one).

Figure 10:
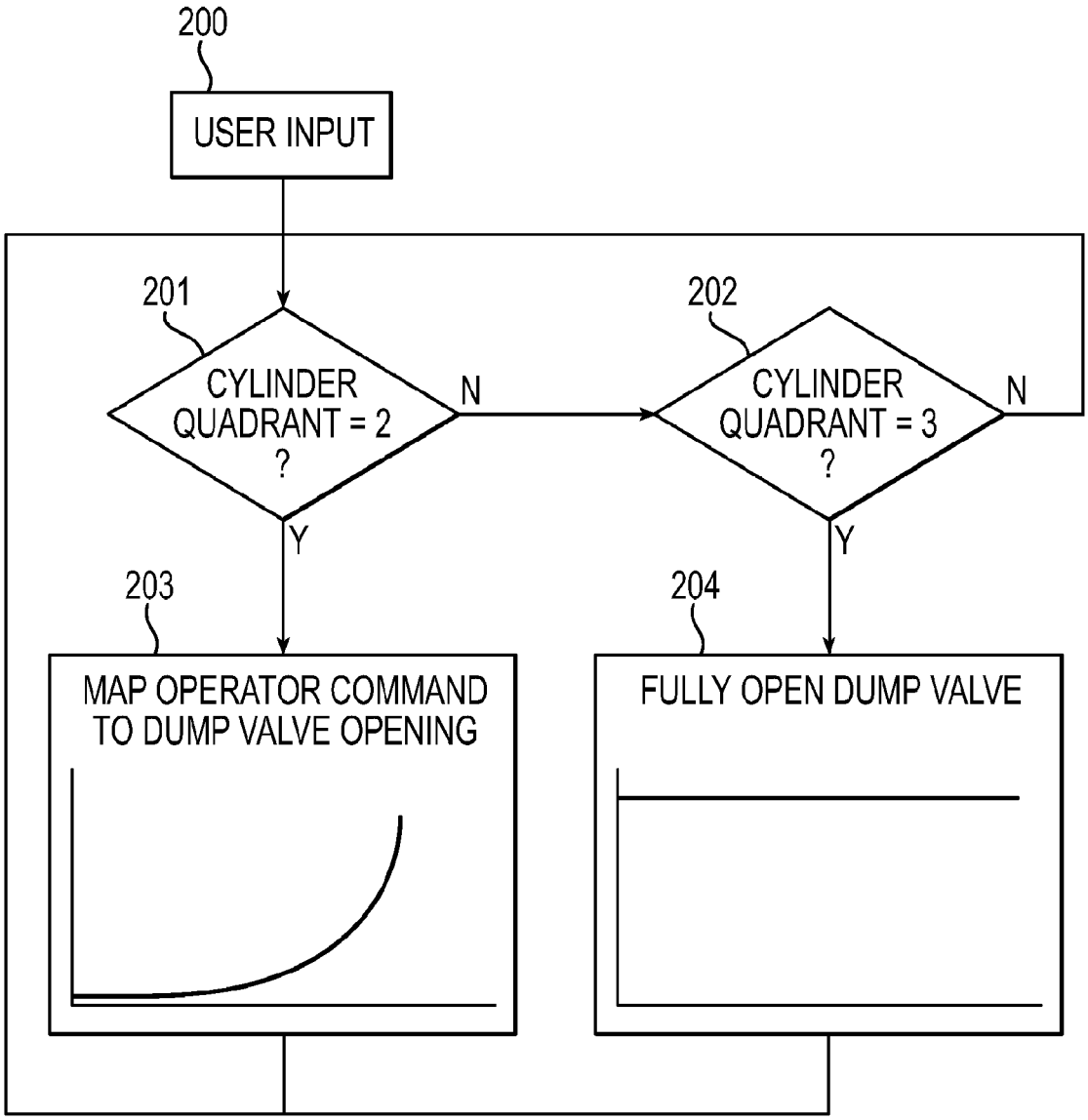
FIG. 10 is an exemplary control schematic in accordance with the present disclosure.

Referring now to FIG. 10, another control scheme is presented that enables a desired actuator velocity to be maintained during an over-center load mode switch event, while doing so in an energy-efficient manner. The control scheme of FIG. 10 may be used in combination with one or more of control schemes corresponding to the embodiments described in FIG. 6 or 9. The control scheme of FIG. 10 is presented in terms of an excavator arm function. It is noted, however, that the control scheme may be applied to any function that having an unbalanced hydraulic cylinder that is subject to an over-center condition.

Beginning at block 200, an operator command is given via an input device, such as a joystick. For example, the joystick may be operatively coupled to an input of the system controller 40, where deflection of the joystick in the positive or negative x-direction provides a positive or negative signal (e.g., a positive or negative voltage, or other signal corresponding to the type of input). The signal can be conditioned as is conventional to develop a speed and direction component for the actuator 24.

Assuming a retract motion is requested by the user, during retraction of the arm (arm linkage curling out) the motion might tend to start with the actuator in quadrant (2) and then transition into quadrant (3) of FIG. 8B. In this scenario, during the start of the motion the head-side chamber 32 pressure may be higher than the rod-side chamber 30 pressure. As the motion starts, these pressures will converge, equalize (at the over-center position) and then diverge as the motion continues, thereby increasing the pressure on the rod-side chamber 30 and reducing the pressure on the head-side chamber 32.

At block 201 it is determined if the actuator 24 is operating in quadrant 2 and if so, then at block 203 the dump valve 46 is commanded to open as a function of joystick deflection. In one embodiment, the function is linear with joystick deflection, and in another embodiment the function is non-linear with respect to joystick deflection.

Mapping of the orifice area to the operator command is such that the pump 14 is forced to pressurize the rod-side connection via conduit 18, thereby forcing the pump 14 (motor 12) to start off in quadrant 3 (FIG. 8A) and stay in the same quadrant during the entirety of the stroke. Therefore, the shuttle valve 52 will not switch during the over-center transition as its rod-side pilot line will always be at a higher pressure than the head-side. The flow from the head-side chamber 32 of the actuator 24 will be throttled through to the dump valve 46 and then will flow through the shuttle valve 52 to feed the inlet of the pump 14. Any excess flow will be directed to the reservoir 66. The actuator quadrant may still have a transition from quadrant (2) to (3) (FIG. 8B), but the pump 14 (motor 12) will always be maintained in quadrant (3) (FIG. 8A). In effect, the pump 14 will refill the rod-side chamber 30 when the actuator 24 is in quadrant (2) and then pressurize the rod-side chamber 30 to further retract the actuator when the actuator is in quadrant (3). This allows the actuator speed to remain unaffected by the actuator over-center transition while also not requiring the pump speed to discretely change at any point during the motion in order to maintain the desired actuator speed.

Moving back to block 201, if it is determined that the actuator 24 is not operating in quadrant (2) (FIG. 8B), then at block 202 it is determined if the actuator 24 is operating in quadrant (3). If the actuator is not operating in quadrant (3), then the method moves back to block 205 as and repeats. However, if the actuator 24 is operating in quadrant (3), this means that the actuator 24 has crossed the over-center location and would need to be pressurized by the pump 14 for further retraction. In this case, there is no need to meter out the flow through the dump valve 46, and the dump valve can be fully opened as indicated at block 204. Therefore, the controller 40, in response to the occurrence of the over-center condition, commands the dump valve 46 to fully open (i.e., the controller 40 controls a state of the dump valve to maintain a velocity of the actuator). By fully opening the dump valve 46, the system is subjected to the least amount of restriction for the flow coming out of the head chamber 32, thus increasing system efficiency. To further increase system efficiency the head-side load holding valve 38 can also be opened with the dump valve 46 while the actuator 24 is operating in quadrant (3).

Figure 11:
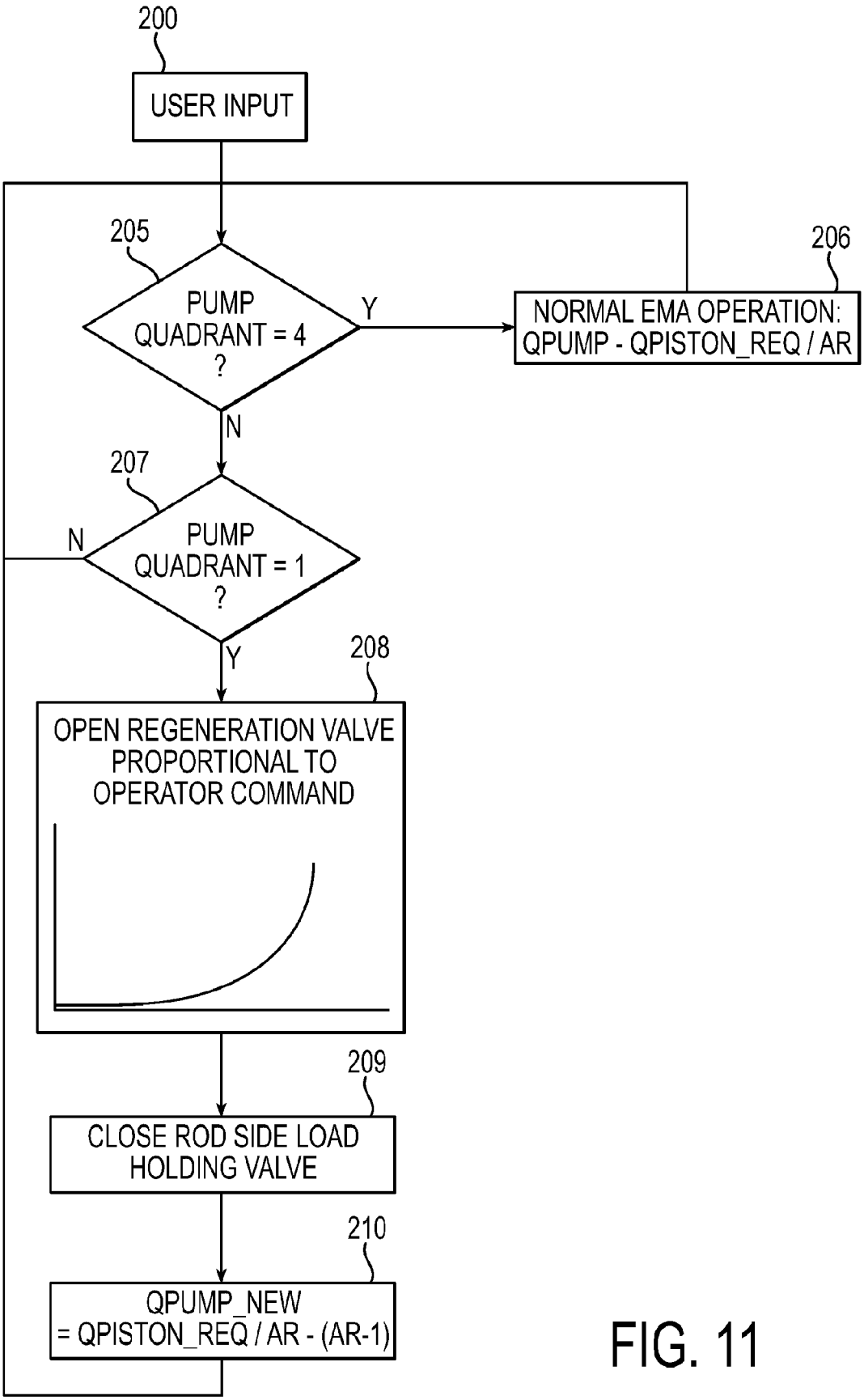
FIG. 11 is another exemplary control schematic in accordance with the present disclosure.

Referring now to FIG. 11, another control scheme in accordance with the present disclosure is presented for an excavator, where the actuator is extended throughout its stroke. In this regard, the motion transitions from being in a load assisted extension to a resistive load extension. This commonly occurs when the arm linkage is brought in towards the machine cab from an outward position after dumping a load.

Figure 1A:
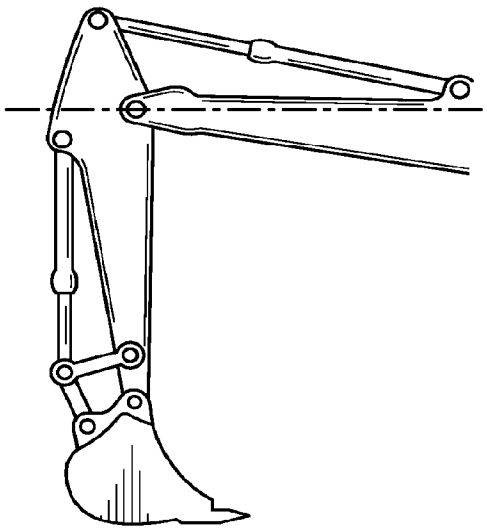
FIGS. 1A, 1B and 1C illustrate an exemplary excavator linkage with arm function where over-center load conditions can occur.
Figure 1B:
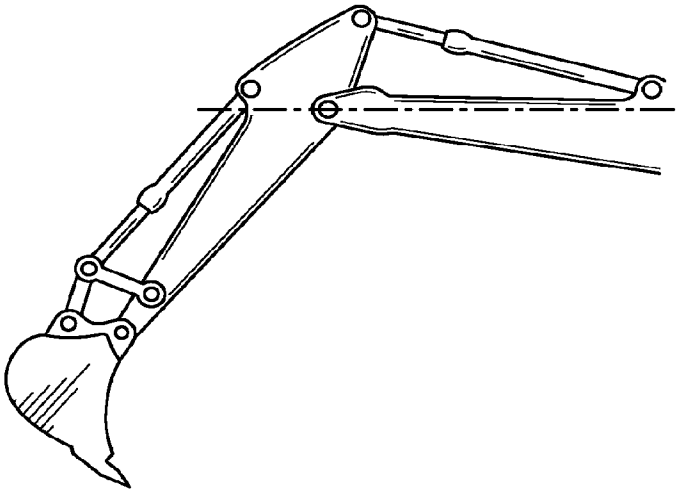
Figure 1C:
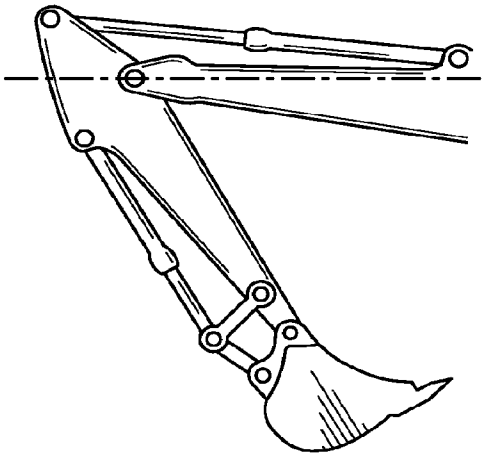

Transition in linkage configuration from FIG. 1(*b*) to FIG. 1(*c*) shows how an over-center condition can occur when the excavator arm actuator is extended. In this scenario, the quadrant switches from 4 (FIG. 1(*b*)) to 1 (FIG. 1(*c*)). In normal EHA operation, the load holding valve 36 on the rod-side chamber 30 is opened to expose the pump 14 to high load pressure while the pump 14 "brakes" the load and accurately controls the actuator velocity. Once the over-center position is reached, the shuttle valve 52 switches from connecting the charge pump 50 to the outlet of the pump 14 on the head-side chamber 32 to now supplying the inlet of the pump 14 as it pressurizes the head-side chamber 32 to further its stroke. At this point, if the pump speed is maintained, the actuator speed will decrease suddenly as the same amount of flow is now being pumped into a larger chamber than prior to the over-center event. The motion starts out similar to normal EHA operation where the rod-side load holding valve 36 is opened to allow higher pressure flow from the rod-side chamber 30 to flow to the pump 14. The system can use the speed and current information provided in the speed and current feedback signal to detect the occurrence of an over-center load condition. Additionally or alternatively, a variety of sensors such as pressure sensors or shuttle valve position sensor 82 may be used to detect the occurrence of an over-center load condition, as described herein.

Beginning at block 200, the operator command is provided by the joystick 200 as described above. At block 205, the controller 40 determines if the motor 12 is operating in quadrant (4) (FIG. 8A). If the motor is operating in quadrant (4), then normal EMA operations are carried out, where $Q_{pump}$ is equal to $Q_{head\ required}$ divided by the area ratio AR. If the motor is not operating in quadrant (4), then the method moves to block 207 where the controller 40 determines if the motor 12 is operating in quadrant (1) (FIG. 8A). If the motor is not operating in quadrant (1), then the method moves back to block 200 and repeats. However, if the motor is operating in quadrant (1), then at block 208 the controller 40 commands the regeneration valve 44 to open, where the degree to which the valve 44 is opened is a function of the user input command as provided, for example, by the joystick. In this regard, the regeneration valve 44 may open as a linear or non-linear function of joystick displacement. Such opening of the regeneration valve 44 avoids unintended extension of the actuator 24 due to flow circulation within the regenerative circuit. Accordingly, the controller 40 also controls a state of the regeneration valve 44 in response to a feedback condition indicating an over-center load condition (e.g., the quadrant of operation) to maintain a velocity of the actuator.

In addition to opening the regeneration valve 44, at block 209 the rod-side holding valve 36 is closed. The closure of the holding valve 36 is coordinated with the opening of the regeneration valve 44. This will allow fluid from the rod-side chamber 30 to flow directly into the head-side chamber 32, which in turn allows more fluid to be pumped into the head-side chamber 32 while not requiring a significant change of the pump speed. The required pump speed is calculated at block 210 as $Q_{pump\ new}=(Q_{head\ required}/AR)*(AR-1)$, and the controller 40 commands the power controller 48 to drive the pump 14 at the calculated speed, where $Q_{head\ required}$ is the calculated flow into the head side of the actuator that results in the required actuator velocity command. If the area ratio AR of the actuator 24 is such that it exactly matches the required theoretical increase in pump speed, the change in pump speed after the over-center position is minimal. The derivation of the theoretical pumps speed is shown below.

In quadrant (4) (FIG. 8A), the pump "brakes" the load on the rod-side (extra flow provided by charge pump) Qhead required=Qpump*AR, where $$AR = \frac{\text{Area of large chamber}}{\text{Area of small chamber}}.$$

In quadrant (1), pump pressure on piston side (charge provides inlet) is given by Qhead resulting=Qpump. If regenerative valve 44 is opened up as transition to quadrant (1) occurs, then $$Qhead\ \text{resulting} = Qpump * \frac{AR}{AR-1}.$$

Since head required=Qpump*AR, Qpump by (AR−1) can be multiplied to get $$Qhead\ \text{resulting} = Qpump * \frac{AR}{AR-1} * (AR-1) = Qpump * AR,$$

which is the required piston flow.

Each of the systems described herein can include an electric motor 12, regeneration valve 44 and dump valve 46 that are controlled for attempting to maintain a desired actuator velocity when the actuator is subjected to an over-center load condition. The systems each include one or more devices for detecting a condition that is indicative of the occurrence of an over-center load condition and for providing feedback signals to a controller 40 for adjusting a speed of the electric motor 12 and/or a state of the valves 44 and 46 in response to such a determination.

Although the principles, embodiments and operation of the present invention have been described in detail herein, this is not to be construed as being limited to the particular illustrative forms disclosed. It will thus become apparent to those skilled in the art that various modifications of the embodiments herein described may be made without departing from the scope of the invention.

What is claimed is:

1. An electro-hydraulic actuation system comprising:

an unbalanced hydraulic actuator capable of motion in retraction and extension directions during movement of a load, the actuator including a first fluid chamber having a first cross-sectional area and a second fluid chamber having a second cross-sectional area, the second cross-sectional area being greater than the first cross-sectional area, the actuator operable in at least one of an actuator second quadrant or an actuator third quadrant;

a regeneration valve in fluid communication with the first fluid chamber and the second fluid chamber, the regeneration valve operable to selectively couple the first fluid chamber to the second fluid chamber;

a dump valve in fluid communication with the second fluid chamber and a fluid reservoir, the dump valve operable to selectively couple the second fluid chamber to the reservoir;

a pump for providing a flow of fluid to the first and second fluid chambers, a displacement of the pump controlling a velocity of the actuator during motion in the retraction and extension directions;

an electric motor for driving the pump, the motor operable in at least one of a first quadrant or a fourth quadrant of operation;

a controller for controlling a state of the regeneration valve and the dump valve; and at least one feedback device for sensing a system condition and for providing a respective feedback signal indicative of the sensed system condition to the controller, the controller being responsive to the respective feedback signal for determining an occurrence of an over-center load condition and for controlling a state of the regeneration valve and the dump valve in response to the occurrence of the over-center load condition in an attempt to maintain the velocity of the actuator, wherein the over-center load condition comprises the hydraulic cylinder undergoing a transition between i) an overrunning load to a resistive load or ii) a resistive load to an overrunning load.

2. The system according to claim 1, wherein the controller is configured to determine the occurrence of the over-center load condition based on at least one of a quadrant of operation of the motor or a quadrant of operation of the actuator.

3. The system according to claim 1, wherein the controller is configured to command the dump valve to a full open position when the actuator is operating in the third quadrant.

4. The system according to claim 1, further comprising a user input device (42) for generating a command corresponding to motion of the actuator.

5. The system according to claim 4, wherein the controller is configured to operate the dump valve as a function of the command when the actuator is operating in the second quadrant.

6. The system according to claim 5, wherein the function is a linear function.

7. The system according to claim 5, wherein the function is a non-linear function.

8. The system according to claim 4, further comprising:

a first load holding valve in fluid communication with the first fluid chamber and the pump, the first load holding valve operable to enable or inhibit fluid flow between the pump and the first fluid chamber; and a second load holding valve in fluid communication with the second fluid chamber and the pump, the second load holding valve operable to enable or inhibit fluid flow between the pump and the second fluid chamber, wherein when the actuator is operating in the third quadrant the controller is configured to operate the regeneration valve as a function of the command, and close the first and second load holding valves.

9. The system according to claim 8, wherein the controller is further configured to calculate a new pump speed.

10. The system according to claim 9, wherein the controller is configured to calculate the pump speed using the equation $Q_{pump\ new}=(Q_{head\ required}/AR)*(AR-1)$, where $Q_{pump\ new}$ is the calculated pump speed, $Q_{head\ required}$ is the calculated flow into the head side of the actuator that results in the required actuator velocity command, and AR is the ratio between the cross sectional area of the second chamber relative to the cross sectional area of the first chamber.

11. The system according to claim 1, further comprising:

a first load holding valve in fluid communication with the first chamber and the pump, the first load holding valve operable to enable or inhibit fluid flow between the pump and the first chamber; and a second load holding valve in fluid communication with the second chamber and the pump, the second load holding valve operable to enable or inhibit fluid flow between the pump and the second, wherein when the motor is operating in the fourth quadrant the controller is configured to command the regeneration valve to close and the first and second load holding valves to open.

12. The system according to claim 1, wherein when the motor is operating in the fourth quadrant the controller is configured to calculate the pump speed using the equation $Q_{pump\ new}=Q_{head\ required}/AR$, where $Q_{pump\ new}$ is the calculated pump speed, $Q_{head\ required}$ is the calculated flow into the head side of the actuator that results in the required actuator velocity command, and AR is the ratio between the cross sectional area of the second chamber relative to the cross sectional area of the first chamber.

13. The system according to claim 1, wherein the feedback device is adapted to sense at least one of a position of a piston of the actuator relative to a housing of the actuator, a velocity of the piston of the actuator relative to the housing of the actuator, or a direction of rotation and current of the motor.

14. The system according to claim 1, wherein the feedback device is located in one of the electric motor or a power electronic controller associated with the electric motor.

15. The system according to claim 13, wherein the controller determines the occurrence of an over-center load condition when a sign of the current changes while a direction of rotation of the electric motor remains unchanged.

16. The system according to claim 13, wherein the feedback device is an actuator position sensing device that is adapted to sense a position of the piston relative to the housing and to provide feedback signals to the system controller at regular intervals, the system controller determining the velocity of the actuator from the feedback signals.

17. The system according to claim 13, wherein the system controller also receives input signals indicative of a desired actuator velocity from an operator input device, the system controller being responsive to a difference between the desired actuator velocity and the determined actuator velocity for modifying the speed of the electric motor.

18. The system according to claim 1, wherein the actuator includes a piston/rod assembly that divides the actuator into the first fluid chamber and the second fluid chamber and moves relative to a housing of the actuator during motion in the retraction and extension directions, one of the first and second fluid chambers being a high pressure chamber during movement of the piston/rod assembly relative to the housing, upon the occurrence of an over-center load condition the high pressure chamber switching to the other of the first and second fluid chambers, the feedback device being responsive to the switching of the high pressure chamber for providing the feedback signal to the controller.

19. The system according to claim 1, wherein the system further includes a charge pump system and a shuttle valve that is responsive to a pressure differential between first and second conduits for connecting the charge pump system in fluid communication with one of the first and second chambers, upon the occurrence of an over-center load condition the shuttle valve switching positions to connect the charge pump system in fluid communication with the other of the first and second fluid chambers, the feedback device (82) being adapted to sense a position of the shuttle valve.

20. The system according to claim 18, wherein the controller determines the occurrence of an over-center load condition when a direction of movement of the piston/rod assembly relative to the housing remains unchanged when the shuttle valve shifts positions.

* * * * *